United States Patent [19]

Bohrdt et al.

[11] 4,151,861

[45] May 1, 1979

[54] REVERSING VALVE

[75] Inventors: Joaquin E. Bohrdt; Klaus Schuler; Gerhard Grieger, all of Berlin, Fed. Rep. of Germany

[73] Assignee: Siemens Aktiengesellschaft, Munich, Fed. Rep. of Germany

[21] Appl. No.: 871,944

[22] Filed: Jan. 24, 1978

[30] Foreign Application Priority Data

Feb. 9, 1977 [DE] Fed. Rep. of Germany ..... 2705914

[51] Int. Cl.[2] ..... F15B 13/042

[52] U.S. Cl. ..... 137/596.18; 137/DIG. 2; 251/297

[58] Field of Search ..... 137/596, 596.18, DIG. 2; 251/297

[56] References Cited

U.S. PATENT DOCUMENTS 3,128,677 4/1964 Tennis ..... 251/297 X

FOREIGN PATENT DOCUMENTS 2047838 3/1972 Fed. Rep. of Germany .... 137/DIG. 2

*Primary Examiner*—Gerald A. Michalsky

*Attorney, Agent, or Firm*—Kenyon & Kenyon, Reilly, Carr & Chapin

[57] ABSTRACT

An improved reversing valve for use in hydraulic actuators of electric high-voltage circuit breakers wherein the valve is of the type comprising: a ball for controlling the path to be reversed; means for continuously subjecting the ball to a pressure force; a movable plunger for loading the ball; a valve body for controlling the path to be reversed connected to the plunger; and a hydraulically movable piston connected to the plunger. The improvement comprises placement of the ball in a first stable end position by the continuous pressure force and the further inclusion in the valve of a roller toggle means responsive to the loading of the ball by the plunger for causing the continuous pressure on the ball to be reduced and the ball to be placed in a second stable condition.

7 Claims, 2 Drawing Figures

REVERSING VALVE

BACKGROUND OF THE INVENTION

1. Field of the Invention

The invention relates to a reversing valve for use in hydraulic actuators of electric high-voltage circuit breakers wherein the valve comprises: a ball for controlling the path to be reversed; means for continuously subjecting the ball to a pressure force; a movable plunger for loading the ball; a valve body for controlling the path to be reversed connected to the plunger; and a hydraulically movable piston connected to the plunger.

2. Description of the Prior Art

German Offenlegungsschrift No. 20 47 838 discloses a reversing valve of the above type in which a ball forms the movable valve member for the reversing process. The ball is moved via an actuating plunger by a spring-loaded piston system which in turn is actuated hydraulically.

German Offenlegungsschrift No. 24 13 409 discloses a further reversing valve of the above type in which again a ball controls the path to be reversed. In this valve, the position of the valve parts effecting the reversing process is determined, on the one hand, by a spring loading the ball and, on the other hand, by a pawl arranged outside the reversing valve.

It is an object of the present invention to provide a reversing valve of the above type whose end positions are stable in the face of pressure fluctuations and whose reversing time is short.

SUMMARY OF THE INVENTION

In accordance with the principles of the present invention the above and other objects are accomplished in a reversing valve of the above type by further providing that the continuous pressure force be such as to place the ball in a first stable end position and by further including in the valve a roller toggle means responsive to the loading of the ball by the plunger for causing the continuous pressure on the ball to be reduced and the ball to be placed in a second stable condition.

With the reversing valve of the invention so formed, the ball can be arranged on the inlet side of the valve and the plunger and the valve body on the outlet side of the valve. Moreover, since the plunger can detach itself from the ball, relatively large outlet cross sections can be realized for aiding the outflow of the medium from the selectably reversible canal of the valve. Also with the present valve, the plunger can be made to undergo in a simple manner relatively short strokes, thereby ensuring short reversing times. Finally, the valve can be simply constructed, since it employs standard parts which are cheap, substantially wear-proof and quickly interchangeable.

In the embodiment of the invention to be disclosed hereinafter, the roller toggle means comprises two guide balls which are arranged one behind the other in the direction of movement of the plunger and between which is interposed at least one spacer ball of smaller diameter. A stationary guide member is common to and receives all the balls and is provided with an outwardly directed radial recess for engaging the spacer ball. This recess can advantageously be designed as a circular slot and can have contact surfaces extending at an angle relative to the direction of motion of the plunger. Further, advantageously, the angle of inclination of the contact surfaces may be about 45°.

Instead of a single spacer ball, the roller toggle means can also include a plurality of such balls interposed in a plane between the guide balls. In the case where two spacer balls are used, in order to ensure a secure snap action, the diameter of the two spacer balls can be selected to be less than one-half the diameter of the guide balls.

BRIEF DESCRIPTION OF THE DRAWING

The above and other features and aspects of the present invention will become more apparent upon reading the following detailed description in conjunction with the accompanying drawings, wherein.

DETAILED DESCRIPTION

Figure 1:
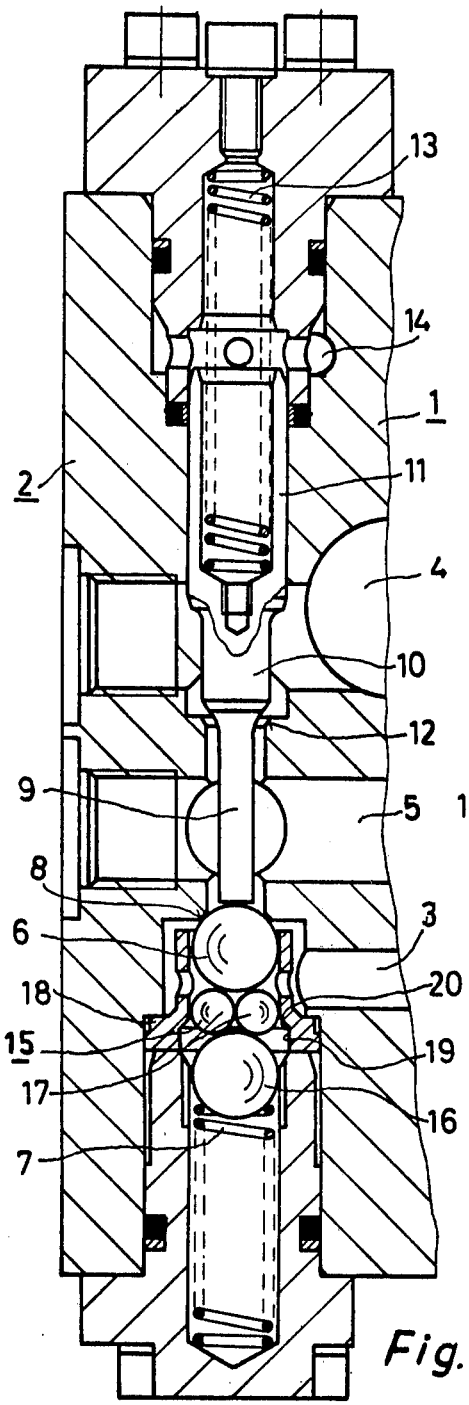
FIG. 1 shows in schematic cross section a reversing valve in accordance with the principles of the present invention.

The reversing valve 1 of FIG. 1 comprises a housing having an inlet 3 and outlet 4 for incoming and outgoing hydraulic fluid, respectively. Associated with the inlet 3 and outlet 4 is a reversible canal 5 whose reversible action is controlled by a ball 6. In particular, the ball 6 is pushed by the force of a compression spring 7 against an associated valve seat 8 and thereby cuts off the connection between the inlet 3 and the canal 5.

A plunger 9, which is connected to a valve body 10 and a hydraulically movable piston 11, is braced against the ball 6. As is shown in FIG. 1, the valve body 10 is lifted off its corresponding seat 12, so that the canal 5 communicates with the outlet 4. The plunger 9 is loaded by a compression spring 13.

In the position shown in FIG. 1, the reversing valve is stable independently of the pressure prevailing in the canals 3, 4 and 5. For reversing the valve, the piston 11 is acted upon by a pressure medium received through a canal 14. This medium causes the piston 11 and therefore the plunger 9 to be moved downward against the force on the ball 6 exerted by the spring 7. As a result, ball 6 is pushed downward, so that the valve body 10 is pushed against and engages its valve seat 12 shutting off the connection between the canal 5 and the outlet 4 and connecting the canal 5 to the inlet 3.

At the same time, the downward motion of the ball 6 actuates a roller toggle device 15, which comprises the ball 6 itself, a further guide ball 16 and two spacer balls 17 arranged in a plane between the balls 6 and 16. In particular, the balls 17, as well as the ball 16, are pushed downward in the "on" position of the reversing valve against the force of the spring 7.

Common to and receiving all the balls 6, 16 and 17 is a guide 18, which has an outwardly directed radial recess 19. Upon movement of the two spacer balls 17 downward, the balls can give way laterally and become secured in the radial recess 19. Therein they are braced against the contact surfaces 20, which extend, preferably, at an angle of 45° to the direction of motion of the plunger 9, so that a division of the resultant force components takes place. This, in turn, causes the force of the spring 7 to be mechanically decreased and the ball 6 to be placed in a second stable end position, which is substantially independent of the pressure of the pressure fluid.

The present reversing valve is advantageous in that in case of a pressure medium flow back from the canal 5 to the outlet 4, the cross section of the outlet valve seat 12 can be chosen large, as the valve body 10 can execute an excess stroke independent of the ball 6. Thereby, the flow cross section can be made substantially larger in the "off" position of the reversing valve than in the "on" position of such valve.

After the flow process during the "off" motion is terminated, the plunger 9 can again rest against the ball 6 due to the force of its spring 13. It is further advantageous through the separate arrangement of the two bodies 10 and 6 to offset their axes of motion. This, in turn, permits the valve to be easily constructed.

Figure 2:
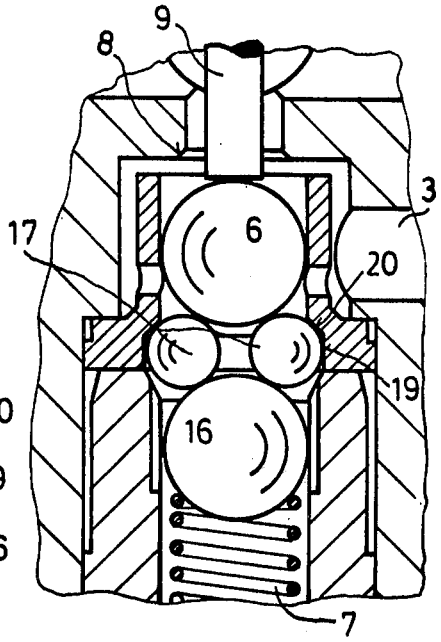
FIG. 2 illustrates an enlarged view of a portion of the valve of FIG. 1.

FIG. 2 shows in exploded fashion the roller toggle arrangement for the above-described "on" position of the reversing valve.

What is claimed is:

1. In a reversing valve for use in a hydraulic actuator of an electric high-voltage circuit breaker, said valve comprising: a ball for controlling the path to be reversed; means for continuously subjecting said ball to a pressure force; a movable plunger for loading said ball; a valve body for controlling said path connected to said plunger; and a hydraulically movable piston connected to said plunger; the improvement comprising:

said continous pressure force places said ball in a first stable end position;

and roller toggle means responsive to the loading of said ball by said plunger for causing said continuous pressure force being exerted on said ball to be reduced and said ball to be placed in a second stable end position.

2. In a reversing valve in accordance with claim 1, the improvement wherein:

said roller toggle means includes:

said ball and a further ball serving as guide balls and arranged one behind the other in the direction of motion of said plunger;

at least one spacer ball interposed between and of smaller diameter than said ball and further ball;

and a stationary guide which is common to and receives all said balls, said guide having an outwardly directed radial recess for engaging said spacer ball.

3. In a reversing valve in accordance with claim 2, the improvement wherein:

said recess is formed as a circular slot.

4. In a reversing valve in accordance with claim 2, the improvement wherein:

said recess has contact surfaces which are at an angle relative to said direction of motion.

5. In a reversing valve in accordance with claim 4, the improvement wherein:

said angle is approximately 45°.

6. In a reversing valve in accordance with claim 2, the improvement wherein:

said roller toggle means includes a plurality of spacer balls interposed in one plane between said ball and further ball.

7. In a reversing valve in accordance with claim 6, the improvement wherein:

said roller toggle means includes two spacer balls whose diameter is less than one-half the diameter of said ball and further ball.

* * * * *